US008811836B2

(12) United States Patent
Kusumoto

(10) Patent No.: US 8,811,836 B2
(45) Date of Patent: Aug. 19, 2014

(54) IMAGE FORMING APPARATUS

(71) Applicant: Kyocera Document Solutions Inc., Osaka (JP)

(72) Inventor: Hiroshi Kusumoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 78 days.

(21) Appl. No.: 13/738,116

(22) Filed: Jan. 10, 2013

(65) Prior Publication Data

US 2013/0188973 A1 Jul. 25, 2013

(30) Foreign Application Priority Data

Jan. 19, 2012 (JP) ..... 2012-008676

(51) Int. Cl.
*G03G 15/08* (2006.01)
*G03G 15/00* (2006.01)

(52) U.S. Cl.
CPC ..... *G03G 15/0824* (2013.01); *G03G 15/556* (2013.01); *G03G 15/0853* (2013.01)
USPC ..... 399/27; 399/255

(58) Field of Classification Search
CPC ..... G03G 15/0824; G03G 15/556; G03G 15/0853; G03G 15/0808; G03G 15/0812
USPC ..... 399/27, 49, 255
See application file for complete search history.

(56) References Cited

U.S. PATENT DOCUMENTS

2011/0194875 A1* 8/2011 Inoue ..... 399/255

FOREIGN PATENT DOCUMENTS

JP 2005043523 A * 2/2005 ..... G03G 15/08
JP 2008-033171 A 2/2008
JP 2009-015052 1/2009

* cited by examiner

*Primary Examiner* — Christopher Mahoney
(74) *Attorney, Agent, or Firm* — Morgan, Lewis & Bockius LLP

(57) ABSTRACT

An image forming apparatus includes a control portion. The control portion determines a developer near end when the residual amount of a developer is in a range from a first predetermined amount to a second predetermined amount, and determines a developer end when the residual amount of the developer is equal to or lower than the second predetermined amount. Besides, in a case where the control portion determines the developer end after a predetermined number of printings are executed in a developer near end state, the control portion supplies the developer from a developer supply device to a development device via a first supply opening, and in a case where the control portion determines the developer end after more than the predetermined number of printings are executed, the control portion supplies the developer from the developer supply device to the development device via a second supply opening.

8 Claims, 7 Drawing Sheets

IMAGE FORMING APPARATUS

INCORPORATION BY REFERENCE

This application is based on and claims the benefit of priority from Japanese Patent Application No. 2012-008676 filed on Jan. 19, 2012, the contents of which are hereby incorporated by reference.

BACKGROUND

The present disclosure relates to an image forming apparatus of a copy machine, a printer, a facsimile, and a multifunction machine of them that use an electro-photographic system, more particularly, to an image forming apparatus that supplies a developer from a developer supply device to a development device.

In an image forming apparatus that uses a two-component developer which contains toners and magnetic carriers, a toner concentration in a development device is detected by means of a toner concentration sensor, and if the toner concentration becomes low, toners are supplied from a developer supply device such as a toner container and the like to the development device. By stirring the developer in the development device and the supplied toners by means of a stir member, a change in the toner concentration in the development device is made small.

When toners are supplied from the developer supply device to the development device via a supply opening and the supplied toners are stirred and conveyed in a convey route in the development device, as the convey distance from the supply opening becomes long, the stir time of the developer increases, accordingly, the change amplitude of the toner concentration becomes small. However, the change amplitude of the toner concentration becomes large near the supply opening, accordingly, there is a problem that unevenness of the toner concentration in the convey direction occurs.

Here, an image forming apparatus is known, which alleviates the unevenness of the toner concentration in the development device. In the image forming apparatus, the development device is provided with two supply openings through predetermined positions in the convey direction of the developer, toners are supplied from the two supply openings at the same time, whereby the change in the toner concentration in the convey direction is alleviated.

In the above image forming apparatus, the toner concentration is detected by means of the toner concentration sensor, and as a result of this, when it is found out that the toner concentration becomes low, toners are supplied from the toner container to the development device. Besides, immediately before toners are supplied, various images are printed. For example, in a case where images having a low coverage rate are sequentially printed and the toner concentration becomes low, because of the sequential printing, the developer is repeatedly stirred. There is a risk that the toners in the development device could be brought to an excessively electrified state thanks to the long-time stirring. When the toners in the development device is in the excessively electrified state and new toners are supplied from the toner container, the supplied toners are supplied to a development roller with being kept at a low electrification. Besides, in a case where printing of many paper sheets is executed immediately before replacement of the toner container, because of the printing of many paper sheets, the developer in the development device is repeatedly stirred. There is a risk that the toners in the development device could be brought to an excessively electrified state thanks to the long-time stirring. When the toners in the development device is in the excessively electrified state and fresh toners are supplied from the toner container, the supplied toners are supplied to the development roller with being kept at a low electrification. There is problem that when an electrostatic latent image on a photoreceptor is developed by using the low-electrification toners, image defects such as image fogging and the like occur.

The present disclosure provides an image forming apparatus that alleviates unevenness of the electrification amount of a developer in a development device in a case where the developer is supplied from a replacing developer supply device to the development device or in a case where the remaining amount of the developer becomes less and a developer is supplied to the development device.

SUMMARY

An image forming apparatus according to an aspect of the present invention includes: a developer supply device that stores a developer; a development device that stirs a developer supplied from the developer supply device by means of a stir member, conveys and supplies the developer to a development roller; a first supply opening that supplies the developer from the developer supply device to the development device; a second supply opening that is disposed at a position having a developer convey distance to the development roller longer than the first supply opening and supplies the developer from the developer supply device to the development device; and a residual amount detection sensor that detects a residual amount of the developer in the development device; and a control portion that based on a detection result from the residual amount detection sensor, determines a developer near end when the residual amount of the developer is in a range from a first predetermined amount to a second predetermined amount that is smaller than the first predetermined amount; determines a developer end when the residual amount of the developer is equal to or lower than the second predetermined amount, and performs control to supply the developer from the developer supply device to the development device via either of the first supply opening and the second supply opening; wherein in a case where the control portion determines the developer end after a predetermined number of printings are executed in a developer near end state, the control portion supplies the developer from the developer supply device to the development device via the first supply opening, and in a case where the control portion determines the developer end after more than the predetermined number of printings are executed in the developer near end state, the control portion supplies the developer from the developer supply device to the development device via the second supply opening.

An image forming apparatus according to another aspect of the present invention includes: a developer supply device that stores a developer; a development device that stirs a developer supplied from the developer supply device by means of a stir member, conveys and supplies the developer to a development roller; a first supply opening that supplies the developer from the developer supply device to the development device; a second supply opening that is disposed at a position having a developer convey distance to the development roller longer than the first supply opening and supplies the developer from the developer supply device to the development device; and a residual amount sensor that detects a residual amount of the developer in the development device; and a control portion that when the residual amount detection sensor detects a residual amount that is equal to or lower than a predetermined amount, performs control to supply the developer from the developer supply device to the development device via either of the first supply opening and the second supply opening. In a case where printing is executed at a predetermined coverage rate and the residual amount detection sensor detects a residual amount that is equal to or lower than the predetermined amount, the control portion supplies the developer from the developer supply device to the development device via the first supply opening, and in a case where the printing at a predetermined coverage rate that is equal to or lower than the predetermined coverage rate is sequentially executed and the residual amount detection sensor detects a residual amount that is equal to or lower than the predetermined amount, the control portion supplies the developer from the developer supply device to the development device via the second supply opening.

DETAILED DESCRIPTION

Hereinafter, an embodiment of the present disclosure is described with reference to the drawings, however, the present disclosure is not limited to this embodiment. Besides, the usage, terms and the like of the present disclosure described here are not limited to this embodiment.

Figure 1:
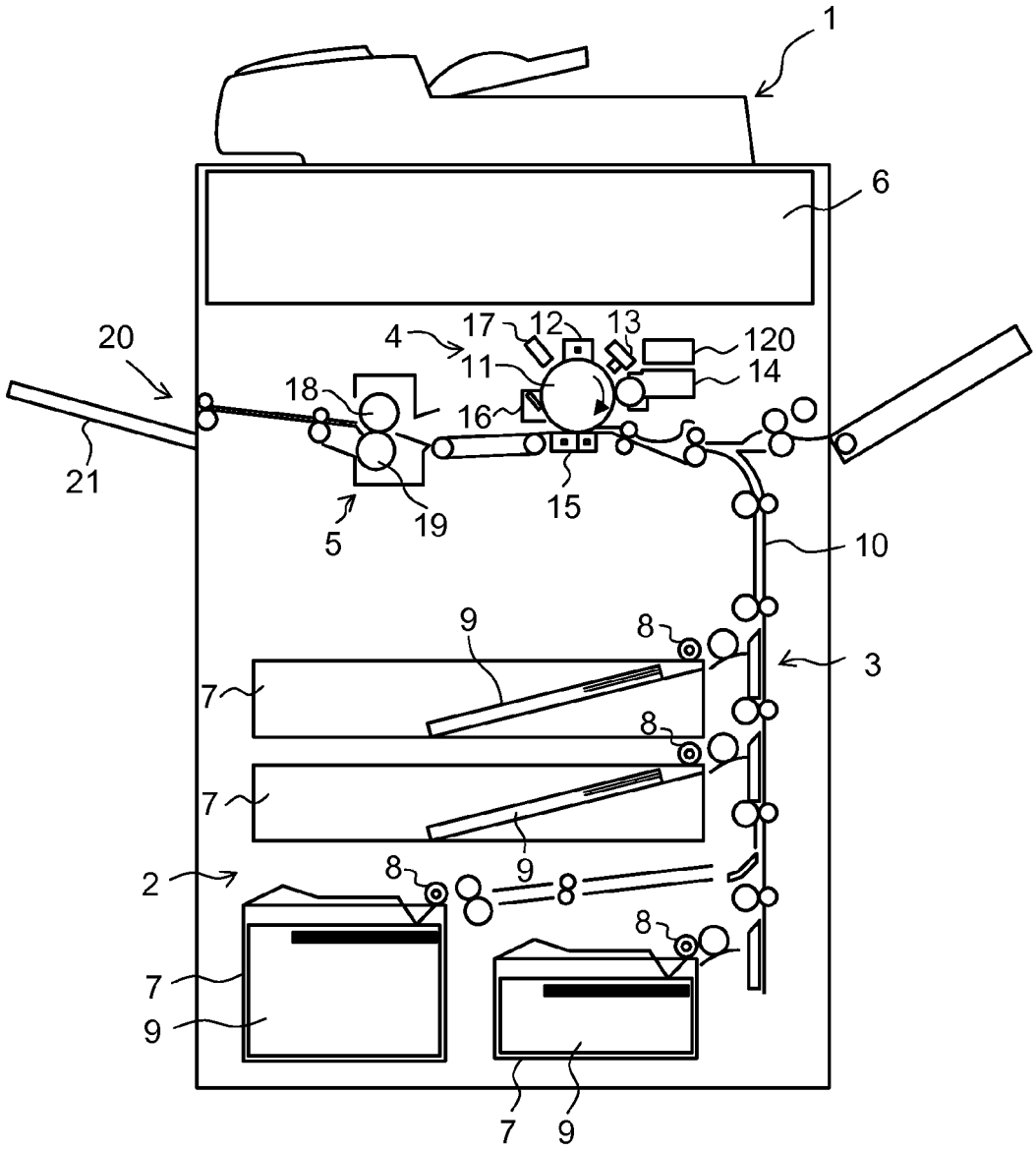
[FIG. 1] is a sectional view schematically showing an image forming apparatus according to an embodiment of the present disclosure.

FIG. 1 is a sectional view of a schematic structure of an image forming apparatus according to the present disclosure. An image forming apparatus 1 includes: a paper sheet supply portion 2 that is disposed in a lower portion; a paper sheet convey portion 3 that is disposed to a right side of the paper sheet supply portion 2; an image forming portion 4 that is disposed over the paper sheet supply portion 2; a fix portion 5 that is disposed in a paper sheet ejection side with respect to the image forming portion 4; an image read portion 6 that is disposed over the image forming portion 4 and the fix portion 5; and a toner container 120 that is a developer supply device.

The paper sheet supply portion 2 includes a plurality of paper sheet supply cassettes 7 that store paper sheets 9, and sends, by means of a paper sheet supply roller 8, the paper sheets 9 one after another from a selected one of the plurality of paper sheet supply cassettes 7 to the paper sheet convey portion 3.

The paper sheets 9 sent to the paper sheet supply portion 3 are conveyed in a paper sheet convey path 10 to the image forming portion 4. The image forming portion 4 is intended to form an image on the paper sheets 9 by means of an electrophotographic process, and includes a photoreceptor 11 that is supported to be rotatable in an arrow direction in FIG. 1; and around the photoreceptor 11 and along its rotation direction, includes: an electrification portion 12; an exposure portion 13; a development device 14; a transfer portion 15; a cleaning portion 16; and an electricity removal portion 17.

The electrification portion 12 includes an electrification wire to which a high voltage is applied, and when a predetermined potential is given to a surface of the photoreceptor 11 by means of a corona discharge from the electrification wire, the surface of the photoreceptor 11 is evenly electrified. And, when light based on image data of a document read by the image read portion 6 is projected to the photoreceptor 11 by the exposure portion 13, the surface potentials of the photoreceptor 11 are selectively attenuated, whereby an electrostatic latent image is formed on the surface of the photoreceptor 11.

Next, the development device 14 supplies toners to the surface of the photoreceptor 11, whereby the electrostatic latent image on the surface of the photoreceptor 11 is developed into a toner image. The toner image on the surface of the photoreceptor 11 is transferred by the transfer portion 15 onto the paper sheet 9 that is conveyed between the photoreceptor 11 and the transfer portion 15. When the toners in the development device 14 are consumed by the development, toners are supplied from the toner container 120.

The paper sheet 9 on which the toner image is transferred is conveyed to the fix portion 5 that is disposed in the downstream side in the paper sheet convey direction with respect to the image forming portion 4. At the fix portion 5, the paper sheet 9 is heated and pressurized by a heat roller 18 heated by a heat source and a pressure roller 19 that comes into tight contact with the heat roller 18, whereby the toner image is melted and fixed on the paper sheet 9. Next, the paper sheet 9 on which the toner image is fixed is ejected onto an ejection tray 21 by a pair of ejection rollers 20.

After the toner image is transferred to the paper sheet 9 by the transfer portion 15, toners remaining on the surface of the photoreceptor 11 are removed by the cleaning member 16, and charges remaining on the surface of the photoreceptor 11 are removed by the electricity removal portion 17. And, the photoreceptor 11 is electrified again by the electrification portion 12, and hereinafter, likewise, the image forming is performed.

Figure 2:
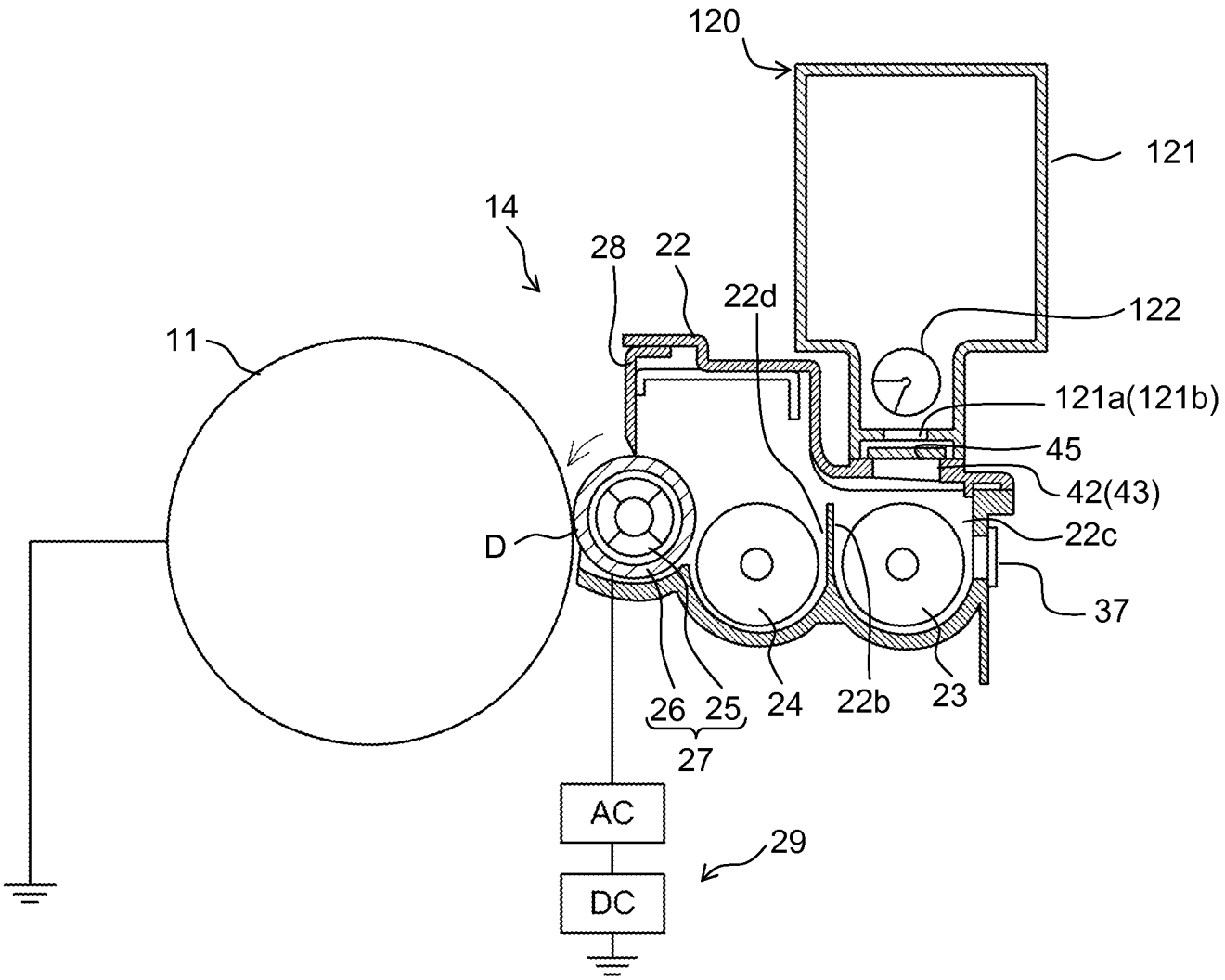
[FIG. 2] is a sectional view schematically showing a development device according to an embodiment of the present disclosure in which a toner container is disposed.

FIG. 2 is a sectional view showing a structure of the development device 34 and the toner container 120 that are used in the above image forming device 1.

The development device 14 includes: a developer vessel 22 that stores a two-component developer composed of toners and magnetic carriers; a first stir member 23 and a second stir member 24 that stir and convey the developer; a development roller 27; a limit member 28; a toner concentration sensor 37 that is a residual amount detection sensor; and a shutter member 45.

The developer vessel 22 composes an outer casing of the development device 14 and is partitioned into a first convey path 22*c* and a second convey path 22*d* by a partition portion 22*b* that protrudes from a lower portion. The developer is stored in the first convey path 22*c* and the second convey path 22*d*. Besides, the developer vessel 22 holds rotatably the first and second stir member 23, 24 and the development roller 27. Besides, the development container 22 is provided with the limit member 28 that opposes a surface of the development roller 27. Further, a first supply opening 42 and a second supply opening 43 are separately formed through an upper wall of the developer vessel 22. When the developer in the developer vessel 22 becomes equal to or lower than a predetermined amount, toners are supplied from the toner container 120 into the developer vessel 22 via the first supply opening 42 or the second supply opening 43. Here, the second supply opening 43 is ranged next to the first supply opening 42 and disposed at a more inner portion in a longitudinal direction (front-rear direction of the paper surface of FIG. 2), accordingly, is in an invisible state in FIG. 2.

The shutter member 45 is intended to open and close the first supply opening 42 and the second supply opening 43, and is disposed on an upper surface of the upper wall of the developer vessel 22 to oppose the first supply opening 42 and the second supply opening 43. Besides, the shutter member 45 is disposed movably in the longitudinal direction (front-rear direction of the paper surface of FIG. 2). Thanks to movement of the shutter member 45 in the longitudinal direction, the first supply opening 42 or the second supply opening 43 is opened, and toners are supplied from the toner container 120 into the developer vessel 22 via either one of the supply openings 42, 43 that is opened.

The first stir member 23 is disposed in the first convey path 22*c*. The second stir member 24 is disposed in the second convey path 22*d* adjacently to the left of the first stir member 23, further, disposed at a lower right position with respect to the development roller 27.

The first and second stir members 23, 24 stir the developer, thereby electrifying the toners of the developer to a predetermined level. According to this, the toners are held by the magnetic carriers. Besides, communications portions 22*e*, 22*f* (see FIG. 3) are disposed at both end portions in the longitudinal direction (front-rear direction of the paper surface of FIG. 2) of the partition portion 22*b* that partitions the first convey path 22*c* and the second convey path 22*d* from each other; the developer is stirred and conveyed in the first convey path 22*c* thanks to rotation of the first stir member 23, and the electrified developer is conveyed from one communication portion 22*e* disposed in the partition portion 22*b* to the second convey path 22*d*. And, the developer is stirred and conveyed in the second convey path 22*d* thanks to rotation of the second stir member 24, and the electrified developer is supplied from the second stir member 24 to the development roller 27

The development roller 27 includes a stationary magnet body 25 and a development sleeve 26. The development sleeve 26 is composed of a cylindrical non-magnetic material, and supported rotatably by the developer vessel 22 at a position adjacent to the second stir member 24. The stationary magnet body 25 is composed of a permanent magnet that is firmly disposed in the development sleeve 26, and generates a magnetic field to the development sleeve 26. Besides, the development roller 27 opposes the photoreceptor 11, that is, an image carrier, over a predetermined gap. The opposing region defines a development region D where to supply the developer carried on the development sleeve 26 to the photoreceptor 11. Further, a development bias 29 including a d.c. and an a.c. superimposed on the d.c. is applied to the development sleeve 26 to supply toners to the photoreceptor 11.

The limit member 28 is intended to limit the developer carried on a surface of the development sleeve 26 to a predetermined layer thickness, has a blade shape, and disposed on the developer vessel 22 substantially right over the development sleeve 26 over a predetermined gap to the surface of the development sleeve 26.

Thanks to magnetic force of the stationary magnet body 25 in the development sleeve 26, the developer supplied from the second stir member 24 is carried on the surface of the development sleeve 26. The carried developer is limited to the predetermined layer thickness by the limit member 28, and conveyed to the development region D thanks to an arrow-direction rotation of the development sleeve 26. The development bias 29 is applied to the development sleeve 26, whereby at the development region D, a potential difference occurs between the development sleeve 26 and the photoreceptor 11, the toners on the development sleeve 26 are supplied to the photoreceptor 11, and an electrostatic latent image on the photoreceptor 11 is developed into a toner image.

Besides, the toner concentration sensor 37, which is intended to detect a toner concentration of the developer stored in the developer vessel 22, is disposed on a right side wall of the first convey path 22*c*. The toner concentration sensor 37 detects magnetic permeability of the developer in the developer vessel 22 at a constant time interval, and based on this magnetic permeability, detects a mix ratio (toner concentration) of the toners and the magnetic carriers of the developer stored in the developer vessel 22. In a case where the toner concentration in the developer vessel 22 is detected by the toner concentration sensor 37 and it is found out that the toner concentration becomes equal to or lower than a predetermined value, toners are supplied from the toner container 120 into the developer vessel 22.

The toner container 120 is intended to supply toners to the development device 14, and is detachably placed on the development device 14. When toners are supplied to the development device 14 and the toners in the toner container 120 run out, a new toner container 120 is placed on the development device 14. The toner container 120 includes: a container vessel 121 that stores unused toners; a first container supply opening 121*a;* a second container supply opening 121*b;* and a convey screw 122.

The first container supply opening 121*a* is an opening that is formed through a bottom portion of the container vessel 121 and supplies toners into the developer vessel 22 via the first supply opening 42 of the development device 14. The second container supply opening 121*b* is an opening that is formed through the bottom portion of the container vessel 121 to be ranged next to the first container supply opening 121*a* in the longitudinal direction (front-rear direction of the paper surface of FIG. 2) and supplies toners into the developer vessel 22 via the second supply opening 43 of the development device 14. When the toner contained 120 is placed on the development device 14, the first container supply opening 121*a* opposes the first supply opening 42 of the development device 14 via the shutter member 45, while the second container supply opening 121*b* opposes the second supply opening 43 of the development device 14 via the shutter member 45. Here, the second container supply opening 121*b* is ranged next to the first container supply opening 121*a* and disposed at a more inner portion in the longitudinal direction (front-rear direction of the paper surface of FIG. 2), accordingly, is in an invisible state in FIG. 2.

The convey screw 122 is intended to convey the toners in the container vessel 121 to the first and second container supply openings 121*a*, 121*b*. The convey screw 122 is disposed in the bottom portion in the container vessel 121 to extend in the longitudinal direction, and disposed to oppose the first and second container supply openings 121*a*, 121*b*.

Besides, the convey screw 122 has two spiral blades that are spirally formed at a constant pitch about an axis that extends in the longitudinal direction. One spiral blade of the convey screw 122 is intended to convey toners to the first supply opening 42, while the other spiral blade is composed of a blade having a phase reverse to the one spiral blade and intended to convey toners to the second supply opening 43. The convey screw 122 rotates, whereby the toners in the container vessel 121 are conveyed to the first and second container supply openings 121*a*, 121*b*. And, when the first supply opening 42 of the development device 14 is opened, the toners are supplied to the development device 14 via the first container supply opening 121*a* and the first supply opening 42, while when the second supply opening of the development device 14 is opened, the toners are supplied to the development device 14 via the second container supply opening 121*b* and the second supply opening 43.

Figure 3:
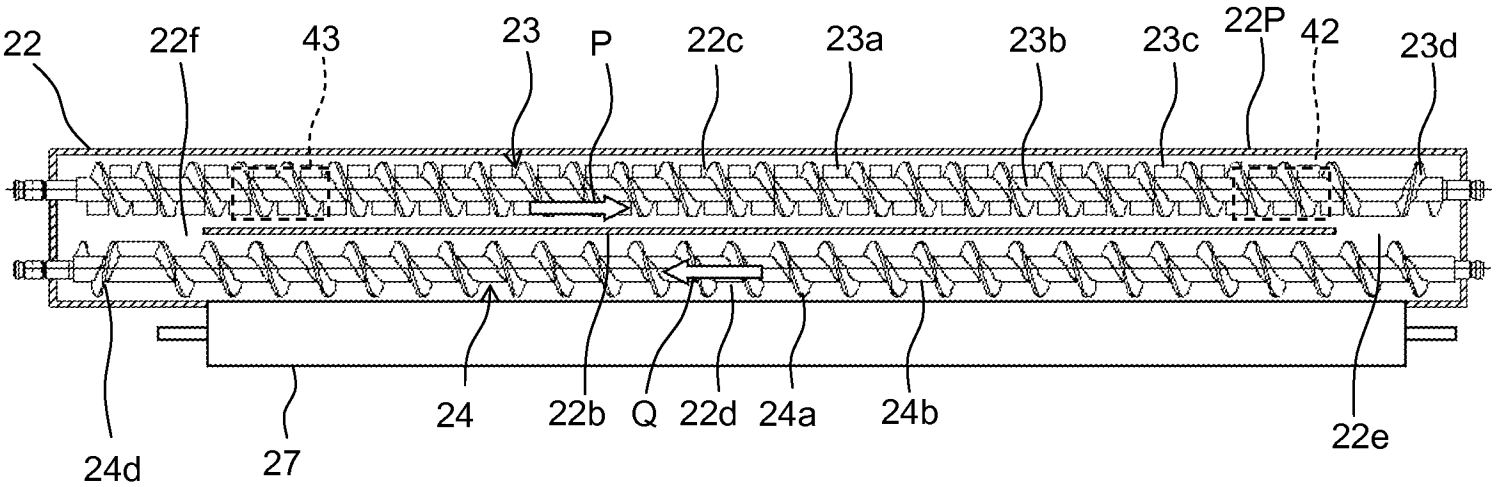
[FIG. 3] is a plan sectional view showing a stir member of a development device according to an embodiment of the present disclosure.

Next, a stir portion of the development device 14 is described in detail by using FIG. 3. FIG. 3 is a plan sectional view when seeing the stir portion from top.

The developer vessel 22 includes as described above: the first convey path 22*c;* the second convey path 22*d;* the partition portion 22*b;* the communication portions 22*e*, 22*f;* and the first and second supply openings 42, 43.

The partition portion 22*b* extends in the longitudinal direction of the developer vessel 22 to partition and range the first convey path 22*c* and the second convey path 22*d* in parallel with each other. The communication portions 22*e*, 22*f* are disposed at both end portions of the partition portion 22*b* in the longitudinal direction, and the developer is able to circulate in the first convey path 22*c*, the communication portion 22*e*, the second convey path 22*d* and the communication portion 22*f*.

The first stir member 23 has: a rotary shaft 23*b;* a first spiral blade 23*a;* a stir rib 23*c;* and a reverse spiral blade 23*d*.

The rotary shaft 23*b* is supported rotatably by side walls of the developer vessel 22. The first spiral blade 23*a* is formed integrally with the rotary shaft 23*b*, and is formed spirally at a constant pitch in a shaft direction of the rotary shaft 23*b*. Besides, the first spiral blade 23*a* extends in the longitudinal direction of the first convey path 22*c* and is disposed to oppose the communication portion 22*f*. The stir rib 23*c* has a flat plate shape, disposed between the first spiral blades 23*a*, and formed integrally with the rotary shaft 23*b*. The reverse spiral blade 23*d* is a blade having a phase in an direction opposite to the first spiral blade 23*a*, formed for at least one pitch, and formed integrally with the rotary shaft 23*b* to oppose the communication portion 22*e*. When the first stir member 23 rotates, the toners and the magnetic carriers are stirred and mixed with each other by the first spiral blade 23*a* and the stir rib 23*c*, the developer is conveyed in the first convey path 22*c* in an arrow direction P, and the developer conveyed in the first convey path 22*c* in the arrow direction P is conveyed by the reverse spiral blade 23*d* from the communication portion 22*e* to the second convey path 22*d*.

The second stir member 24 has: a rotary shaft 24*b;* a second spiral blade 24*a;* and a reverse spiral blade 24*d*.

The rotary shaft 24*b* is disposed in parallel with the rotary shaft 23*b* and supported rotatably by the side walls of the developer vessel 22. The second spiral blade 24*a* is formed integrally with the rotary shaft 24*b*, and formed spirally at a constant pitch in a shaft direction of the rotary shaft 24*b*. Besides, the second spiral blade 24*a* is formed to extend by a length longer than a shaft direction length of the development roller 27 in the second convey path 22*d*, and formed to oppose the communication portion 22*e*. The reverse spiral blade 24*d* is a blade having a phase in an direction opposite to the second spiral blade 24*a*, formed for at least one pitch, and formed integrally with the rotary shaft 24*b* to oppose the communication portion 22*f*. When the second stir member 24 rotates, the toners and the magnetic carriers are stirred and mixed with each other by the second spiral blade 24*a*, the developer is conveyed in the second convey path 22*d* in an arrow direction Q, and the developer conveyed in the second convey path 22*d* in the arrow direction Q is conveyed by the reverse spiral blade 24*d* from the communication portion 22*f* to the first convey path 22*c*.

Accordingly, during an image forming time, when the first stir member 23 is rotated together with the development roller 27 by the drive sources such as a motor, a group of gears and the like that are not shown, the developer is conveyed in the first convey path 22*c* in the arrow direction P. Associating with the first stir member 23, when the second stir member 24 rotates reversely with respect to the first stir member 23 at the same rotation speed, the developer is conveyed in the second convey path 22*d* in the arrow direction Q. In other words, the developer is stirred and circulated from the first convey path 22*c*, the communication portion 22*e*, the second convey path 22*d* and to the communication portion 22*f*. And, the stirred developer is supplied from the second stir member 24 to the development roller 27.

The first supply opening 42 is formed through the upper wall of the developer vessel 22 and disposed in a downstream side (right side of FIG. 3) of the first convey path 22*c*. The second supply opening 43 is formed through the upper wall of the developer vessel 22 and disposed in an upstream side (left side of FIG. 3) of the first convey path 22*c*. Thanks to the disposition of the first and second supply openings 42 and 43, the second supply opening 43 is disposed at a position that has a toner convey distance to the development roller 27 longer than the first supply opening 42. In other words, the convey distance of the toners supplied from the first supply opening 42 to the development roller 27 becomes a length of the communication portion 22*e* plus the second convey path 22*d* for one circulation in the convey paths, while the convey distance of the toners supplied from the second supply opening 43 to the development roller 27 becomes a length of the first convey path 22*c* plus the communication portion 22*e* and plus the second convey path 22*d* for one circulation in the convey paths.

When the existing developer stored in the development device 14 is stirred for a long time, the electrification amount of the toners of the developer increases, and the toners and the magnetic carriers join electrostatically firmly to each other. In this state, to supply new toners from the toner container 120 to the development device 14 and to evenly electrify the new toners and the toners of the existing developer in the development device 14, it is necessary to stir and mix them for a long time by means of the first and second stir members 23, 24.

For example, in a case where images having a relatively low coverage rate are sequentially printed, the consumption amount of the toners for the printing is small, accordingly, the timing for supplying the new toners to the development device 14 delays, and the developer in the development device 14 is stirred by the first and second stir members 23, 24 for a long time. The developer is stirred for the long time, whereby the toners in the development device 14 are brought to an excessively electrified state. In this state, when the toners in the development device 14 decreases to a predetermined amount and toners are supplied from the toner container 120, the toners are supplied from the second supply opening 43. The convey route from the second supply opening 43 to the development roller 27 is longer than the convey route from the first supply opening 42 to the development roller 27, accordingly, even if the toners in the development device 14 are in the excessively electrified state, the supplied toners and the developer in the development device 14 are stirred and mixed for a relatively long time. According to this, the supplied toners are sufficiently electrified, and unevenness of the electrification amount of the toners of the developer in the development device 14 is alleviated.

Besides, in a case where toners are supplied after the toner container 120 is replaced, there is a case where the electrification amount of the toners in the development device 14 becomes uneven. Usually, thanks to the toners supply from the toner container 120 to the development device 14, the toners in the toner container 120 gradually decrease. And, when the toners in the toner container 120 substantially run out and the toners in the development device 14 decrease to an extent that the toners in the development device 14 cause image deterioration, a toner end (developer end) is set and a warning on the toner end is displayed on an operation panel and the like of the image forming apparatus 1. Finding the warning display of the toner end, a user replaces the toner container 120. In order for the user to take a time span for preparing the toner container 120 for the replacement prior to the toner end, immediately before the toner end, a near end (developer near end) is set in a state in which an amount of the developer for allowing the image forming remains in the development device 14, and a warning on the near end is displayed on the operation panel of the image forming apparatus 1.

Here, in a case where relatively many printings are executed in the state in which the toners in the toner container 120 substantially run out and the near end is set, the developer in the development device 14 is stirred for a long time by the first and second stir members 23, 24. The developer is stirred for the long time, whereby the toners in the development device 14 are brought to an excessively electrified state. In this state, when the toner end comes; the toner container 120 is replaced; and toners are supplied from the replacing toner container 120 to the development device 14, the toners are supplied from the second supply opening 43. The convey route from the second supply opening 43 to the development roller 27 is longer than the convey route from the first supply opening 42 to the development roller 27, accordingly, even if the toners in the development device 14 are in the excessively electrified state, the supplied toners and the developer in the development device 14 are stirred and mixed for a relatively long time. According to this, the supplied toners are sufficiently electrified, and the unevenness of the electrification amount of the toners of the developer in the development device 14 is alleviated.

Figure 4A:
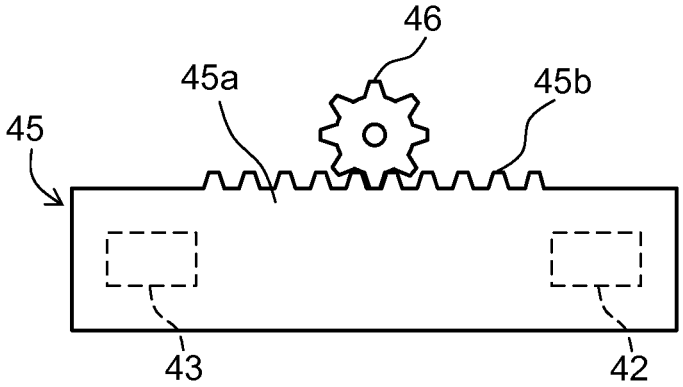
[FIG. 4A] is a plan view showing a state in which a shutter member according to an embodiment of the present disclosure closes a first supply opening and a second supply opening.
Figure 4B:
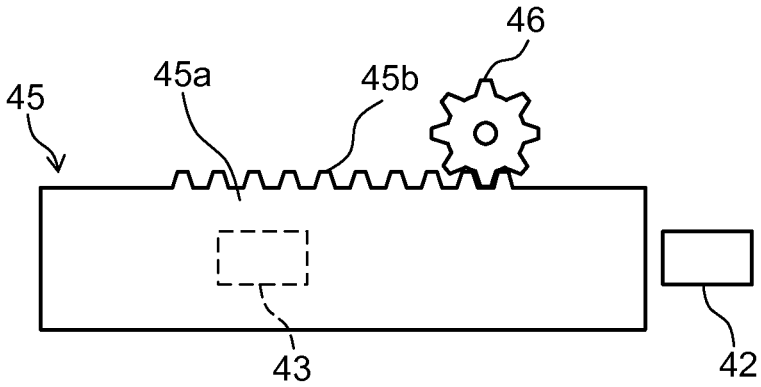
[FIG. 4B] is a plan view showing a state in which a shutter member according to an embodiment of the present disclosure opens a first supply opening.
Figure 4C:
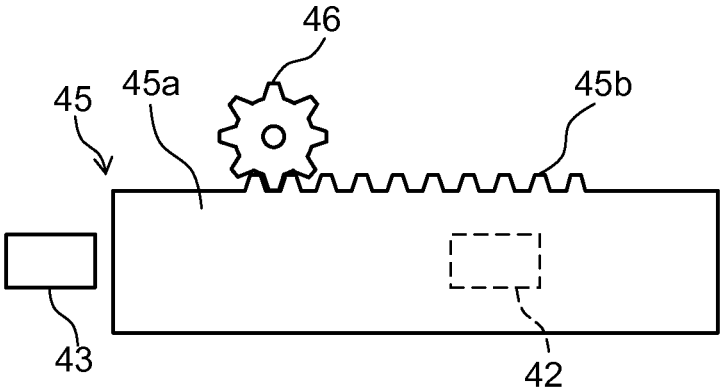
[FIG. 4C] is a plan view showing a state in which a shutter member according to an embodiment of the present disclosure opens a second supply opening.

FIG. 4A, FIG. 4B and FIG. 4C are plan views showing a schematic structure of the shutter member 45 that opens and closes the first supply opening 42 and the second supply opening 43. FIG. 4A shows a state in which the first and second supply openings 42 and 43 both are closed, besides, FIG. 4B shows a state in which the first supply opening 42 is opened, and further, FIG. 4C shows a state in which the second supply opening 43 is opened.

As shown in FIG. 4A, the shutter member 45 has a shutter plate 45*a* that extends in the longitudinal direction and a rack 45*b* that is formed on one end surface of the shutter plate 45*a* in the longitudinal direction.

The shutter plate 45*a* has a length that is able to close the first supply opening 42 and the second supply opening 43 at the same time, and held by the upper wall of the developer vessel 22 (see FIG. 2) to be movable in a left-right direction (longitudinal direction) in FIG. 4A. In other words, the shutter plate 45*a* is movable from a position shown in FIG. 4A to a first position (position in FIG. 4B) where the first supply opening 42 is opened and the second supply opening 43 is closed and to a second position (position in FIG. 4C) where the first supply opening 42 is closed and the second supply opening 43 is opened. Here, the position (position in FIG. 4A) to close the first and second supply openings 42 and 43 is a third position.

When the shutter member 45 is disposed at the first position (position in FIG. 4B), the toners become suppliable from the toner container 120 into the developer vessel 22 via the first supply opening 42. When the shutter member 45 is disposed at the second position (position in FIG. 4C), the toners become suppliable from the toner container 120 into the developer vessel 22 via the second supply opening 43. When the toners are not supplied from the toner container 120 into the developer vessel 22, the shutter member 45 is disposed at the third position (position in FIG. 4A).

The rack 45*b* meshes with a pinion 46 that is driven and rotated by drive means such as a motor and the like that are not shown. In a case where the shutter member 45 is disposed at the third position, when the pinion 46 rotates in a forward direction (clockwise direction in FIG. 4A), the shutter member 45 moves to the first position. On the other hand, when the pinion 46 rotates in a reverse direction (counterclockwise direction in FIG. 4A), the shutter member 45 moves to the second position. Here, in a case where the shutter member 45 is composed of one shutter plate 45*a* that separately opens and closes the first and second supply openings 42 and 43, the open and close mechanism and the drive means become a simple structure. However, the shutter member 45 may be structured to have separate shutter plates for the first supply opening 42 and the second supply opening 43, and the respective shutter plates may be moved to the open position and the close position separately from each other by drive means such as a solenoid and the like.

By controlling the rotation driving and rotation direction of the pinion 46 and controlling the rotation driving of the convey screw 122 (see FIG. 2) of the toner container 120, toners are supplied from the first supply opening 42 or from the second supply opening 43 to the development device 14.

Figure 5:
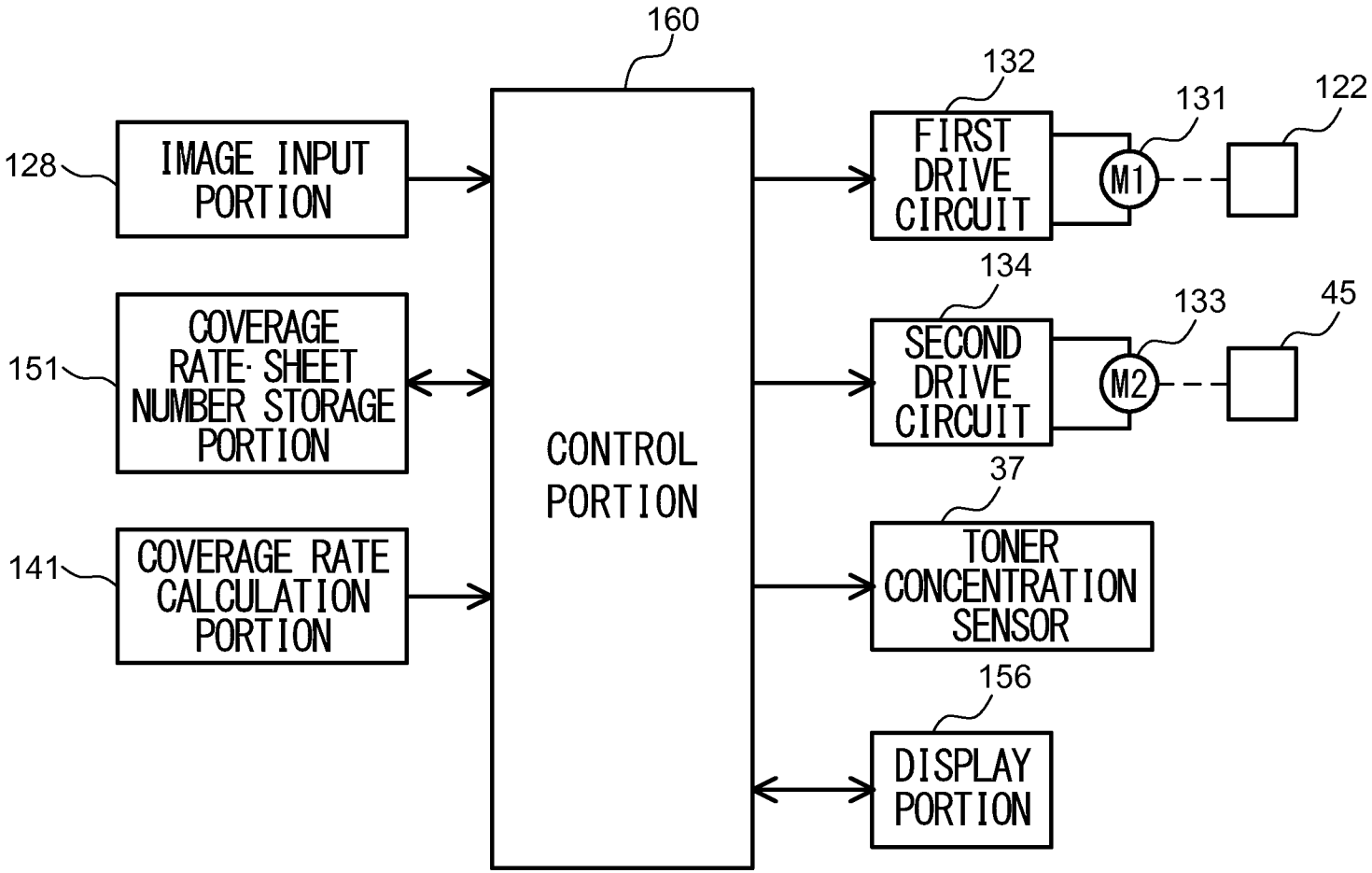
[FIG. 5] is a block diagram showing a control portion according to an embodiment of the present disclosure and its peripheral portion.
Figure 6:
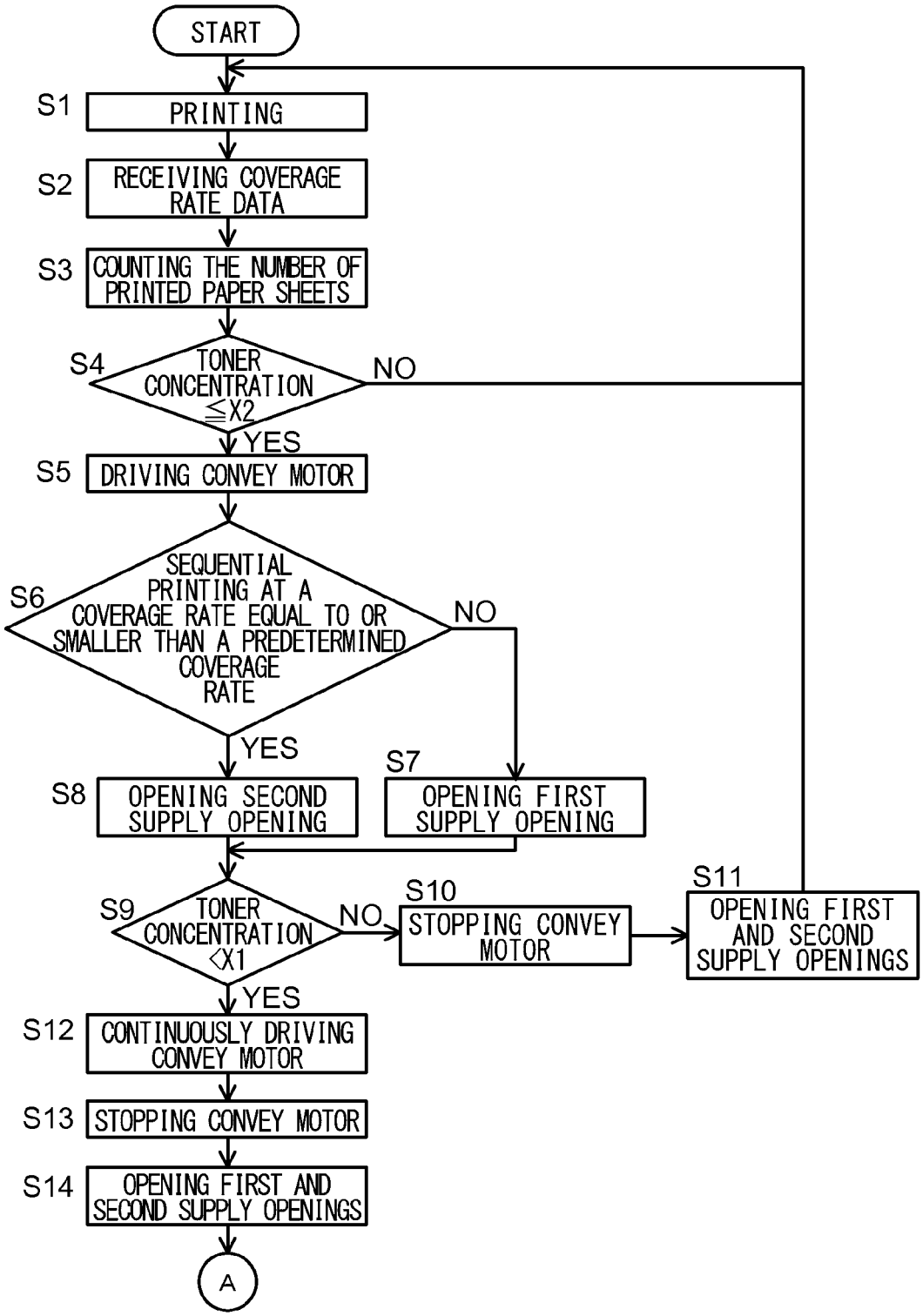
[FIG. 6] is a first-half flow chart showing control of developer supplying in a control portion according to an embodiment of the present disclosure.
Figure 7:
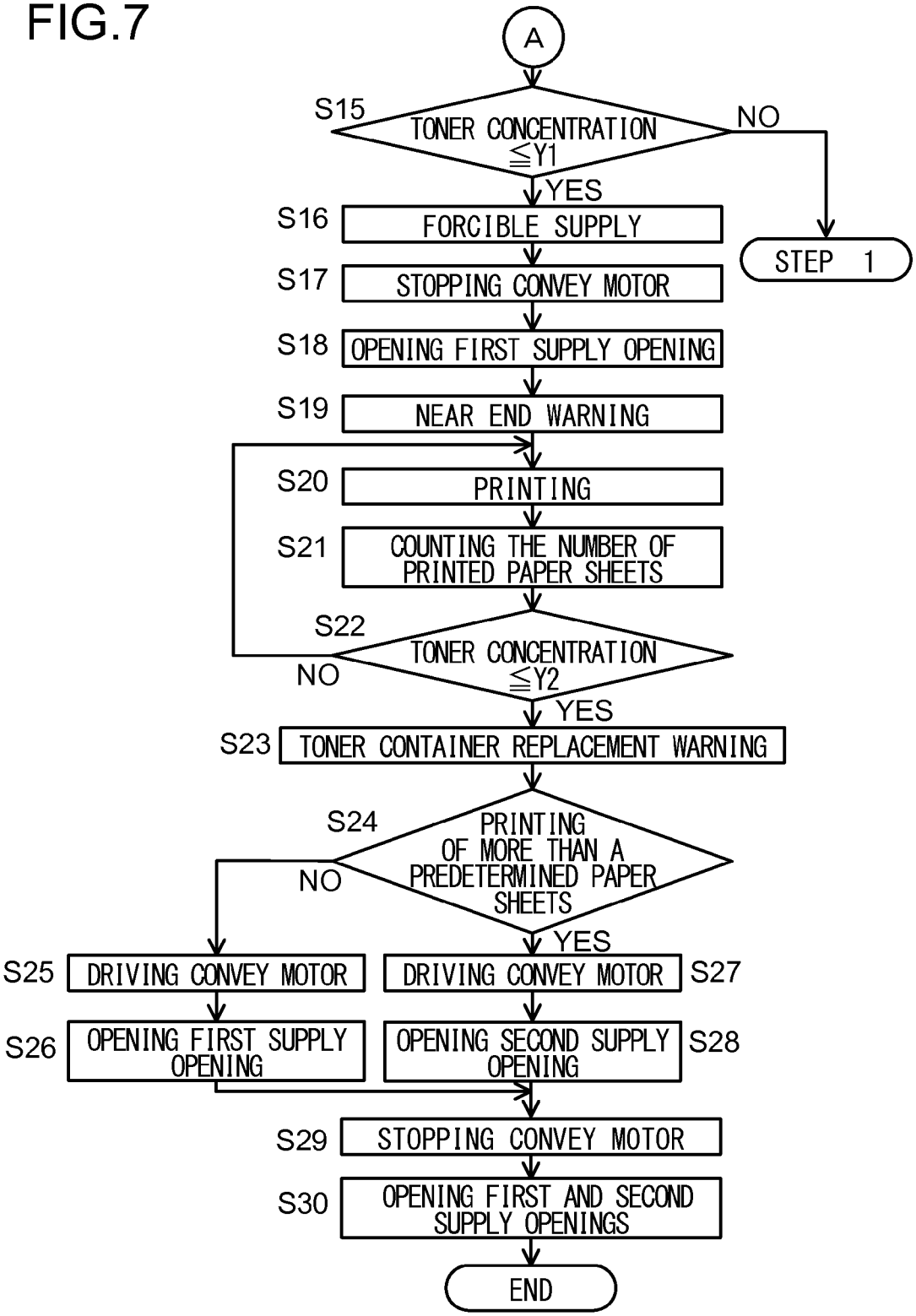
[FIG. 7] is a second-half flow chart showing control of developer supplying in a control portion according to an embodiment of the present disclosure.

The pinion 46 (shutter member 45) and the convey screw 122 are controlled by a control portion. FIG. 5 is a block diagram showing a control portion 160 and its peripheral portion. FIG. 6 and FIG. 7 are flow charts showing control of toner supply by the control portion 160. FIG. 6 shows a first-half control of the toner supply, while FIG. 7 shows a second-half control of the toner supply.

As shown in FIG. 5, the control portion 160 includes, around its peripheral portion, a convey motor 131 that drives and rotates the convey screw 122; a first drive circuit 132 that drives the convey motor 131; a shutter motor 133 that drives the shutter member 45; a second drive circuit 134 that drives the shutter motor 133; and the toner concentration sensor 37. Besides, the control portion 160 includes, around its peripheral portion, an image input portion 128 that inputs image data to be printed into the control portion 160; a coverage rate calculation portion 141; a coverage rate·sheet number storage portion 151 that stores the coverage rate and the number of printed paper sheets; and a display portion 156. And, based on the toner concentration in the development device 14, the coverage rate of an output image formed and the number of printed paper sheets, the control portion 160 controls the rotation driving of the convey motor 131, the rotation driving and rotation direction of the shutter motor 133, executes determination on the near end and the toner end, and displays the near end and the toner end on the display portion 156.

The control portion 160 is composed of a microcomputer, memory devices such as a RAM, a ROM and the like and others, and controls the first drive circuit 132, the second drive circuit 134 and the display portion 156 in accordance with a program and data set in the memory devices and based on a signal input from the image input portion 128 and a signal detected by and input from the toner concentration sensor 37.

Based on a signal related to the image data that are sent from the image input portion 128 to the control portion 160, the coverage rate calculation portion 141 calculates a percentage (coverage rate) of the data such as letters and the like to be printed to the entire paper sheet on which an image is formed. The coverage rate is a percentage of the toner amount used for each image forming to the toner amount used for an entire-surface black image.

The coverage rate·sheet number storage portion 151 is composed of memory devices such as a RAM and the like that are rewritable, and stores the number of printed paper sheets and the coverage rate of each printing. In other words, the coverage rate·sheet number storage portion 151 integrates the number of printed paper sheets every time the signal related to the image data is input from the image forming portion 128 into the control portion 160, and stores the coverage rates that correspond to the respective image data.

The toner concentration sensor 37 detects a magnetic permeability of the developer in the developer vessel 22 (see FIG. 2) and detects a toner concentration of the developer based on the magnetic permeability. In a case where the toner concentration is high, an output voltage from the toner concentration sensor 37 becomes low, while in a case where the toner concentration is low, the output voltage from the toner concentration sensor becomes high. And, a plurality of threshold values X1, X2, X1 and Y2 set beforehand for toner concentrations are stored in the memory devices such as the ROM and the like of the control portion 160.

The control portion 160 compares an input value from the toner concentration sensor 37 with the first stationary concentration X1, the second stationary concentration X2, the first lower limit concentration (first predetermined amount) Y1, and the second lower limit concentration (second predetermined amount smaller than the first predetermined amount in toner amount) that is lower than the first lower limit concentration in toner concentration, and in accordance with the result, determines whether it is necessary to supply toners from the toner container 120 to the development device 14 or not.

Specifically, in a case where a sufficient amount of toners are stored in the toner container 120, the toner supply from the toner container 120 is controlled such that the toner concentration (residual toner amount) of the toners in the development device 14 is situated between the toner concentration that corresponds to the first stationary concentration X1 and the toner concentration that corresponds to the second stationary concentration X2.

In a case where the toner concentration detected by the toner concentration sensor 37 becomes equal to or lower than the first lower limit concentration Y1; the convey screw 122 is driven and rotated for a predetermined time; toners are supplied (forcible supply) from the toner container 120 to the development device 14; and the toner concentration exceeds the second lower limit concentration, that is, a case where the detection result from the toner concentration sensor 37 is equal to or smaller than the first lower limit concentration Y1 and is larger than the second lower limit concentration Y2, it is determined that the toner container 120 is in a near end state.

In a case where when the printing is being executed in the near end state, toners are supplied from the toner container 120 to the development device 14 and the toner concentration detected by the toner concentration sensor 37 is larger than the second lower limit concentration Y2, the toner container 120 is kept in the near end state. However, in a case where the toner concentration detected by the toner concentration sensor 37 is equal to or lower than the second lower limit concentration Y2, it is determined that the toner container 120 is in a toner end state.

The display portion 156 has an operation panel composed of a liquid crystal device, is able to perform input operations of a print instruction, a print sheet number, a sheet size and the like, and to display an operation instruction, a warning and the like. Based on the detection result from the toner concentration sensor 37, the control portion 160 determines the near end or the toner end, and based on the determination result, instructs the display portion 156 to display the warning on the near end or the toner end. Here, the near end or the toner end may be warned by means of a buzzer and a voice.

The first drive circuit 132 is composed of a bridge circuit that applies a pulse voltage to the convey motor 131, drives and rotates the convey motor 131 by applying the pulse voltage. The control portion 160 sends a drive signal to the first drive circuit 132, and based on the drive signal, the first drive circuit 132 drives and rotates the convey motor 131.

The second drive circuit 134 is composed of a bridge circuit that applies a pulse voltage to the shutter motor 133, applies the pulse voltage to drive and rotate the pinion 46 that moves the shutter member 45. The control portion 160 sends a drive signal and a rotation direction signal to the second drive circuit 134, and the second drive circuit 134 drives and rotates the shutter motor 133 based on the drive signal, and drives and rotates the shutter motor 133 in a forward direction or a reverse direction based on the rotation direction signal The rotation direction signal is switched based on the number of printed paper sheets and the coverage rate.

During a usual supply time, based on the flow chart shown in FIG. 6, the control portion 160 controls the driving of the convey motor 131 and the shutter motor 133. Besides, during the near end state or during the replacement time of the toner container 120 after the toner end, based on the flow chart shown in FIG. 7, the control portion 160 controls the driving of the convey motor 131 and the shutter motor 133.

As shown in FIG. 6, in a step 1, the photoreceptor 11, the development roller 27, the first and second stir members 23, 24 and the like are driven and rotated, a toner image is transferred onto the paper sheet 9 by the image forming portion 4, and the transferred toner image is fixed onto the paper sheet by the fix portion 5. Besides, in the step 1, the convey motor 131 for rotating the convey screw 122 stops rotating, further, the shutter motor 133 stops rotating in the state in which the shutter member 45 closes both of the first and second supply openings 42, 43.

In a step 2, the coverage rate calculation portion 141 calculates the coverage rate based on the signal related to the image data that are sent from the image input portion 128 to the control portion 160. And, in a step 3, the coverage rate is stored into the coverage rate·sheet number storage portion 151, and the number of printed paper sheets is stored together with the coverage rate every time the printing is performed.

In a step 4, the toner concentration sensor 37 detects the toner concentration of the developer in the development device 14, and compares a toner concentration signal input from the toner concentration sensor 37 with the second stationary concentration X2 stored in the memory device.

In the step 4, in a case where the toner concentration signal is larger than the second stationary concentration X2 (case of NO in the step 4), a sufficient amount of toners are stored in the development device 14, returning to the step 1, the next print instruction is awaited, if there is the next print instruction, the printing is executed. In a case of executing the printing, in the steps 2 and 3, the coverage rate of the printing is calculated and the number of printed paper sheets is integrated every time the printing is executed, and the number of printed paper sheets and the coverage rate of every printing are stored into the coverage rate·sheet number storage portion 151.

On the other hand, in the step 4, in a case where the toner concentration signal is equal to or lower than the second stationary concentration X2 (case of YES in the step 4), the toners in the development device 14 decrease, accordingly, toners are supplied from the toner container 120 to the development device 14. In a step 5, for the toner supply, the drive signal is sent to the first drive circuit 132, and the convey motor 131 of the toner container 120 is rotated by the drive signal.

Next, in a step 6, the so-far integrated number of printed paper sheets and coverage rate of every printing stored in the coverage rate·sheet number storage portion 151 are checked.

In the step 6, in a case where a predetermined number of printings, which have a coverage rate equal to or lower than a predetermined coverage rate, are not executed sequentially, to supply toners from the first supply opening 42 in a step 7, the first supply opening 42 is opened. To open the first supply opening 42, the drive signal and the forward rotation signal are sent to the second drive circuit 134, and the shutter motor 133 is driven and rotated in the forward direction by the drive signal and the forward rotation signal. The convey motor 131 rotates and the shutter motor 133 is driven and rotated in the forward direction, whereby toners are supplied from the toner container 120 to the development device 14 via the first supply opening 42. In this case, as a result of executing the printings that have a relatively large coverage rate, the toners decrease by a predetermined amount for a small number of printed pater sheets, and the existing developer in the development device 14 is not stirred for a long time by the first and second stir members 23, 24. Accordingly, the toners of the existing developer are in a suitably electrified state, the supplied toners and the existing developer are stirred and mixed in the convey route from the first supply opening 42 to the development roller 27, whereby the supplied toners are sufficiently electrified. As a result of this, the unevenness of the electrification amount of the toners of the developer in the development device 14 is alleviated. Besides, the convey route from the first supply opening 42 to the development roller 27 is relatively short, accordingly, the supplied toners are not excessively stirred, and an image, whose concentration unevenness is alleviated, is obtained.

On the other hand, in the step 6, in a case where the predetermined number of printings, which have a coverage rate equal to or lower than the predetermined coverage rate, are executed sequentially, to supply toners from the second supply opening 43 in a step 8, the second supply opening 43 is opened. To open the second supply opening 43, the drive signal and the reverse rotation signal are sent to the second drive circuit 134, and the shutter motor 133 is driven and rotated in the reverse direction by the drive signal and the reverse rotation signal. The convey motor 131 rotates and the shutter motor 133 is driven and rotated in the reverse direction, whereby toners are supplied from the toner container 120 to the development device 14 via the second supply opening 43. In this case, as a result of executing the printings that have a relatively small coverage rate, the toners decrease by a predetermined amount, and the existing developer in the development device 14 is stirred for a long time by the first and second stir members 23, 24. Accordingly, the toners of the existing developer are in an excessively electrified state, however, by supplying new toners from the second supply opening 43, the convey route from the second supply opening 43 to the development roller 27 becomes relatively long, and the supplied toners and the existing developer are stirred and mixed for a relatively long time. Because of the stirring and mixing for the relatively long time, the supplied toners are sufficiently electrified, and the unevenness of the electrification amount of the toners of the developer in the development device 14 is alleviated.

Next, in a step 9, after the toner supply, the toner concentration signal input from the toner concentration sensor 37 and the first stationary concentration X1 stored in the memory device are compared with each other. The first stationary concentration X1 is set at a toner concentration higher than the second stationary concentration X2. When a toner concentration corresponding to a toner concentration between the first stationary concentration X1 and the second stationary concentration X2 is detected, a sufficient amount of toners are stored in the toner container 120.

In the step 9, in a case where the toner concentration signal is equal to or larger than the first stationary concentration X1 (case of NO in the step 9), a predetermined amount of toners are supplied into the development device 14, and, in a step 10, the rotation of the convey motor 131 is stopped, further, in a step 11, to close the first and second supply openings 42, 43, the shutter motor 133 is rotated by a predetermined amount in the direction reverse to the direction in which the shutter motor 133 is rotated to open the first and second supply openings 42, 43. The rotation of the convey motor 131 is stopped, besides, returning to the step 1, the next print instruction is awaited with the first and second supply openings 42, 43 closed.

On the other hand, in the step 9, in a case where the toner concentration signal is lower than the first stationary concentration X1 (case of YES in the step 9), in a step 12, the convey motor 131 is continuously driven and rotated and toners are supplied to the development device 14. And, in a step 13, when a predetermined time span elapses after the continuous rotation driving of the convey motor 131, the rotation of the convey motor 131 is stopped, besides, in a step 14, to close the first and second supply openings 42, 43, the shutter motor 133 is rotated by a predetermined amount in the direction reverse to the direction in which the shutter motor 133 is rotated to open the first and second supply openings 42, 43.

As shown in FIG. 7, in a step 15, after the toner supply, the toner concentration signal input from the toner concentration sensor 37 and the first lower limit concentration Y1 stored in the memory device are compared with each other. The first lower limit concentration Y1 is the toner concentration for determining the near end of the toner container 120 as described above.

In the step 15, in a case where the toner concentration signal is larger than the first lower limit concentration Y1 (case of NO in the step 9), the toner container 120 is not in the near end state and toners are supplied into the development device 14, and returning to the step 1, the next print instruction is awaited.

On the other hand, in the step 15, in a case where the toner concentration signal is equal to or smaller than the first lower limit concentration Y1 (case of YES in the step 15), it is determined that the toner container 120 is in the near end state, and in a step 16, toners are forcibly supplied to the development device 14. For example, in the forcible supply, the first supply opening 42 is opened, and the convey motor 131 is rotated for a predetermined time at a speed different from the usual rotation or in the reverse direction, whereby substantially all the toners remaining in the toner container 120 are supplied to the development device 14.

When the forcible supply is completed, in a step 17, the rotation of the convey motor 131 is stopped, further, in a step 18, to close the first supply opening 42, the shutter motor 133 is rotated by a predetermined amount in the direction reverse to the direction in which the shutter motor 133 is rotated to open the first supply opening 42. In a step 19, the warning on the near end is displayed on the display portion 151 with the toner supply to the development device 14 stopped.

In a step 20, based on the print instruction, the photoreceptor 11, the development roller 27, the first and second stir members 23, 24 and the like are driven and rotated, a toner image is transferred onto the paper sheet 9 by the image forming portion 4, and the transferred toner image is fixed onto the paper sheet by the fix portion 5.

In a step 21, the number of printed paper sheets is counted, and the number of printed paper sheets is stored into the coverage rate·sheet number storage portion 151.

in a step 22, the toner concentration signal input from the toner concentration sensor 37 and the second lower limit concentration Y2 stored in the memory device are compared with each other. In other words, by executing the printing, the toners in the development device 14 decrease, and it is determined whether or not it is possible to perform the development by means of the residual toners in the development device 14 in which a good image is obtained.

In the step 22, in a case where the toner concentration signal is larger than the second lower limit concentration Y2 (case of NO in the step 22), toners usable for the development remain in the development device 14, accordingly, returning to the step 20, the printing is executed. Next, in the step 21, the number of printed paper sheets is integrated, and the integrated number of printed paper sheets is stored into the coverage rate·sheet number storage portion 151. In the step 22, the printing is repeatedly executed until the toner concentration signal becomes equal to or lower than the second lower limit concentration Y2, and the number of printed paper sheets is integrated.

In the step 22, in a case where the toner concentration signal becomes equal to or smaller than the second lower limit concentration Y2 (case of YES in the step 22), it is the toner end state, accordingly, in a step 23, a waning for prompting the replacement of the toner container 120 is displayed on the display portion 156. And, in a case where a user performs the replacement with a new toner container 120, thanks to the replacement of the toner container 120, a replacement completion signal is input into the control portion 160. Based on the replacement completion signal, a step 24 and the following routine for supplying toners from the new toner container 120 to the development device 14 are executed.

In the step 24, checking is performed for the number of paper sheets that are printed in the near end state, that is, the number of printed paper sheets integrated in the coverage rate·sheet number storage portion 151.

in the step 24, in a case where more than the predetermined number of printings are not executed, in a step 25, for the toner supply, the drive signal is sent to the first drive circuit 132 to rotate the convey motor 131. Next, in a step 26, to supply toners from the first supply opening 42, the first supply opening 42 is opened. To open the first supply opening 42, the drive signal and the forward rotation signal are sent to the second drive circuit 134, and the shutter motor 133 is driven and rotated in the forward direction by the drive signal and the forward rotation signal. The convey motor 131 rotates and the shutter motor 133 is driven and rotated in the forward direction, whereby toners are supplied from the toner container 120 to the development device 14 via the first supply opening 42. In this case, the number of printed paper sheets is relatively small, accordingly, during the toner end time, the remaining developer in the development device 14 is not stirred for a long time by the first and second stir members 23, 24. Accordingly, the toners of the remaining developer in the development device 14 are in a suitably electrified state, and the supplied toners and the remaining developer are stirred and mixed in the convey route from the first supply opening 42 to the development roller 27, whereby the supplied toners are sufficiently electrified, and the unevenness of the electrification amount of the toners of the developer in the development device 14 is alleviated.

On the other hand, in the step 24, in a case where more than the predetermined number of printings are executed, in a step 27, for the toner supply, the drive signal is sent to the first drive circuit 132 to rotate the convey motor 131. Next, in a step 28, to supply toners from the second supply opening 43, the second supply opening 43 is opened. To open the second supply opening 43, the drive signal and the reverse rotation signal are sent to the second drive circuit 134, and the shutter motor 133 is driven and rotated in the reverse direction by the drive signal and the reverse rotation signal. The convey motor 131 rotates and the shutter motor 133 is driven and rotated in the reverse direction, whereby toners are supplied from the toner container 120 to the development device 14 via the second supply opening 43. In this case, the number of printed paper sheets is relatively large, accordingly, during the toner end time, the remaining developer in the development device 14 is stirred for a long time by the first and second stir members 23, 24. Accordingly, the toners of the remaining developer in the development device 14 are in a suitably electrified state, however, by performing the supply from the second supply opening 43, the convey route from the second supply opening 43 to the development roller 27 becomes relatively long, and the supplied toners and the remaining developer are stirred and mixed for a relatively long time. Because of the stirring and mixing for the relatively long time, the supplied toners are sufficiently electrified, and the unevenness of the electrification amount of the toners of the developer in the development device 14 is alleviated.

When the predetermined amount of toners are supplied from the new toner container 120 into the development device 14, in a step 29, the rotation of the convey motor 131 is stopped, further, in a step 30, to close the first and second supply openings 42, 43, the shutter motor 133 is rotated by the predetermined amount in the direction reverse to the direction in which the shutter motor 133 is rotated to open the first and second supply openings 42, 43. The rotation of the convey motor 131 is stopped, besides, the next print instruction is awaited with the first and second supply openings 42, 43 closed.

Here, in the above embodiment, the example is described, in which in the development device 14, the layer thickness of the developer carried on the development roller 27 is limited by the limit member 28; toners are supplied from the development roller 27 to the photoreceptor 11, whereby the electrostatic latent image on the photoreceptor 11 is developed into the toner image, however, the present disclosure is not limited to this, and may be applied to a development device that includes a development roller and a magnetic roller, carries a magnetic brush on the magnetic roller, supplies only toners to the development roller, and flies the toners on the development roller to a photoreceptor.

Besides, in the above embodiment, the example is described, in which the present disclosure is applied to the toner container 120 that stores the toners only of the two-component developer, however, the present disclosure is not limited to this, and the toner container 120 may store a developer that contains toners and magnetic carriers.

Besides, in the above embodiment, the example is described, in which the present disclosure is applied to the two-component developer that contains toners and magnetic carriers, however, the present disclosure is not limited to this, and may be applied to a one-component developer that is composed of magnetic toners.

Besides, in the above embodiment, the structure is described, in which the residual amount sensor is composed of the toner concentration sensor 37 that detects the magnetic permeability of the developer, however, the present disclosure is not limited to this, and as the residual amount detection sensor, it is possible to suitably select one from a piezo-sensor, an optical sensor and the like based on the kind of the developer, the measurement accuracy, the disposition structure and the like.

Besides, in the above embodiment, the example is described, in which the convey screw 122 of the toner container 120 is composed of the spiral blade that conveys toners to the first supply opening 42 and the spiral blade composed of the reverse phase blade that conveys toners to the second supply opening 43, however, the present disclosure is not limited to this, and a structure may be employed, in which the convey screw 122 is composed of a spiral blade that has a one-direction phase, when conveying toners to the first supply opening 42, control is performed to drive and rotate the convey screw 122 in the forward direction, and when supplying toners to the second supply opening 43, control is performed to drive and rotate the convey screw 122 in the reverse direction.

The present disclosure is usable for an image forming apparatus of a copy machine, a printer, a facsimile, and a multi-function machine of them that use an electro-photographic system, more particularly, to an image forming apparatus that supplies a developer from a developer supply device to a development device.

What is claimed is:

1. An image forming apparatus comprising:

a developer supply device that stores a developer;

a development device that stirs a developer supplied from the developer supply device by means of a stir member, conveys and supplies the developer to a development roller;

a first supply opening that supplies the developer from the developer supply device to the development device;

a second supply opening that is disposed at a position having a developer convey distance to the development roller longer than the first supply opening and supplies the developer from the developer supply device to the development device; and a residual amount detection sensor that detects a residual amount of the developer in the development device; and a control portion that when based on a detection result from the residual amount detection sensor, determines a developer near end when the residual amount of the developer is in a range from a first predetermined amount to a second predetermined amount that is smaller than the first predetermined amount; determines a developer end when the residual amount of the developer is equal to or lower than the second predetermined amount, and performs control to supply the developer from the developer supply device to the development device via either of the first supply opening and the second supply opening; wherein in a case where the control portion determines the developer end after a predetermined number of printings are executed in a developer near end state, the control portion supplies the developer from the developer supply device to the development device via the first supply opening, and in a case where the control portion determines the developer end after more than the predetermined number of printings are executed in the developer near end state, the control portion supplies the developer from the developer supply device to the development device via the second supply opening.

2. The image forming apparatus according to claim 1, further comprising:

a shutter member that opens and closes the first supply opening and the second supply opening; and a drive means that opens and closes the shutter member; wherein the control portion drives the drive means to open the first supply opening when supplying the developer via the first supply opening, and drives the drive means to open the second supply opening when supplying the developer via the second supply opening.

3. The image forming apparatus according to claim 2, wherein the shutter member is composed of one shutter plate that opens and closes the first and second supply openings.

4. The image forming apparatus according to claim 1, further comprising:

a first convey path in which the developer is stirred by a first stir member and conveyed;

a second convey path in which the developer is stirred by a second stir member, conveyed in a direction opposite to the first convey path and which is disposed to oppose the development roller;

a partition member that partitions the first and second convey paths from each other; and a communication portion that is opened at both ends in a longitudinal direction of the partition member such that the developer circulates from the first convey path into the second convey path; wherein the first supply opening is disposed in a downstream side of the first convey path in the developer convey direction, and the second supply opening is disposed in an upstream side of the first convey path in the developer convey direction.

5. An image forming apparatus comprising:

a developer supply device that stores a developer;

a development device that stirs a developer supplied from the developer supply device by means of a stir member, conveys and supplies the developer to a development roller;

a first supply opening that supplies the developer from the developer supply device to the development device;

a second supply opening that is disposed at a position having a developer convey distance to the development roller longer than the first supply opening and supplies the developer from the developer supply device to the development device; and a residual amount detection sensor that detects a residual amount of the developer in the development device; and a control portion that when the residual amount detection sensor detects a residual amount that is equal to or lower than a predetermined amount, performs control to supply the developer from the developer supply device to the development device via either of the first supply opening and the second supply opening; wherein in a case where printing is executed at a predetermined coverage rate and the residual amount detection sensor detects a residual amount that is equal to or lower than the predetermined amount, the control portion supplies the developer from the developer supply device to the development device via the first supply opening, and in a case where the printing at a predetermined coverage rate that is equal to or lower than the predetermined coverage rate is sequentially executed and the residual amount detection sensor detects a residual amount that is equal to or lower than the predetermined amount, the control portion supplies the developer from the developer supply device to the development device via the second supply opening.

6. The image forming apparatus according to claim 5, further comprising:

a shutter member that opens and closes the first supply opening and the second supply opening; and a drive means that opens and closes the shutter member; wherein the control portion drives the drive means to open the first supply opening when supplying the developer via the first supply opening, and drives the drive means to open the second supply opening when supplying the developer via the second supply opening.

7. The image forming apparatus according to claim 6, wherein the shutter member is composed of one shutter plate that opens and closes the first and second supply openings.

8. The image forming apparatus according to claim 5, further comprising:

a first convey path in which the developer is stirred by a first stir member and conveyed;

a second convey path in which the developer is stirred by a second stir member, conveyed in a direction opposite to the first convey path and which is disposed to oppose the development roller;

a partition member that partitions the first and second convey paths from each other; and a communication portion that is opened at both ends in a longitudinal direction of the partition member such that the developer circulates from the first convey path into the second convey path; wherein the first supply opening is disposed in a downstream side of the first convey path in the developer convey direction, and the second supply opening is disposed in an upstream side of the first convey path in the developer convey direction.

* * * * *